US008167673B2

(12) United States Patent
Hartmann et al.

(10) Patent No.: US 8,167,673 B2
(45) Date of Patent: May 1, 2012

(54) METHOD FOR MANUFACTURING A SPARK PLUG HAVING A LATERALLY ORIENTED GROUND ELECTRODE

(75) Inventors: Detlef Hartmann, Bamberg (DE); Jochen Fischer, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 366 days.

(21) Appl. No.: 12/221,353

(22) Filed: Aug. 1, 2008

(65) Prior Publication Data

US 2009/0066211 A1 Mar. 12, 2009

(30) Foreign Application Priority Data

Sep. 7, 2007 (DE) ..... 10 2007 042 790

(51) Int. Cl.
*H01T 21/02* (2006.01)

(52) U.S. Cl. ..... 445/7
(58) Field of Classification Search ..... None
See application file for complete search history.

(56) References Cited

U.S. PATENT DOCUMENTS 6,676,468 B2 * 1/2004 Ishiguro et al. ..... 445/7

FOREIGN PATENT DOCUMENTS

EP 0 765 017 3/1997

* cited by examiner

*Primary Examiner* — Toan Ton
*Assistant Examiner* — Britt D Hanley
(74) *Attorney, Agent, or Firm* — Kenyon & Kenyon LLP

(57) ABSTRACT

A method for manufacturing a spark plug having a central electrode and a ground electrode, the central electrode and the ground electrode being spaced apart from each other and a first planar electrode face being formed on the central electrode and a second planar electrode face being formed on the ground electrode by a separative manufacturing method.

8 Claims, 6 Drawing Sheets

METHOD FOR MANUFACTURING A SPARK PLUG HAVING A LATERALLY ORIENTED GROUND ELECTRODE

FIELD OF THE INVENTION

The present invention relates to a method for manufacturing a spark plug and to a spark plug having a laterally oriented ground electrode.

BACKGROUND INFORMATION

The performance of an engine is determined by the quality of its components, in particular that of the spark plugs. Spark plugs represent one of the most heavily used core components in the engine compartment which, due to the electrical and physical forces acting on them when the fuel mixture is ignited, are subject to increased wear compared to other components.

Spark plugs are essentially composed of a ceramic housing and the two electrodes, the ground electrode and the central electrode. The actual layers (referred to as electrode faces hereinafter) are applied to the opposing faces of the particular electrode in the form of pins for producing a spark, which are mostly made of an expensive noble metal alloy. There is a gap, known as spark gap, between the two electrode faces.

At ignition, a high voltage is generated periodically in the spark gap by an ignition system controlled by the engine, which discharges in a sparkover between the two electrode faces of the spark plug. The spark generated then ignites the compressed air-fuel mixture. Since the sensitive electrode faces are exposed to extremely high temperatures every time a spark is generated, the individual components of the spark plug must be optimally adjusted to ensure a long life even in extended use.

Spark plugs having a laterally oriented ground electrode may be used instead of those in which the ground electrode covers the central electrode from above because the air-fuel mixture may better reach the spark gap between the two electrode faces. However, problems arise in manufacturing an electrode system having a laterally oriented ground electrode. To orient the ground electrode laterally with respect to the central electrode, the ground electrode must be mechanically bent into the correct shape. Furthermore, to make it possible to apply the pin correctly to the electrode front side, the pin should have a certain minimum length. Otherwise the two faces to be attached to each other cannot be optimally welded together. The sum of the lengths of the pin and the electrode yields the total length of the ground electrode. However, since the distance to the central electrode is strongly limited and, in addition, it spatially shields the location where the ground electrode should be placed, the ground electrode must be relatively short, so that, after being bent into the correct shape, a sufficient spark gap still remains between the electrode faces of the ground electrode and the central electrode. Controlled, defined bending of a short, solid piece of metal is the more difficult the shorter is the piece of metal to be bent.

European patent document EP 0 765 017 A1 discusses a spark plug electrode which includes a cylindrical central electrode and two ground electrodes, each ground electrode having a curved front side whose curvature approximately corresponds to the reciprocal of the curvature of the cylindrical central electrode. This should ensure that the distance between the two electrode surfaces is the same along the entire electrode surfaces, so that the spark discharge acts on the entire electrode surface, rather than on only some areas. A spark plug of this type is, however, very complex and expensive to manufacture.

SUMMARY OF THE INVENTION

The method according to the present invention for manufacturing a spark plug having the features of Patent Claim 1 is characterized in that a spark plug may thus be manufactured which provides optimized inflammability. Furthermore, the spark plug thus manufactured has outstanding durability due to minimized spark erosive wear, which considerably increases the service life of this spark plug. Acceptance by the user is thus enhanced to a considerable degree. Furthermore, the simplicity of the manufacturing method compared to other manufacturing methods is also advantageous. This is achieved in that the method according to the present invention for manufacturing a spark plug having a central electrode and a ground electrode includes the central electrode and the ground electrode being spaced from each other and a first planar electrode face being formed on the central electrode and a second planar electrode face being formed on the ground electrode by a separative manufacturing method. The separative manufacturing method has also the following decisive advantage: Shaping the ground electrode is considerably facilitated thereby without further hardware or additional costs.

Further aspects of the method according to the present invention for manufacturing a spark plug are described herein as to the exemplary embodiments of the present invention.

In manufacturing the planar electrode faces of the spark plug according to the present invention, a single-stage or multistage separative manufacturing method may be used. This means that the planar electrode faces of the ground electrode and the central electrode may be formed using appropriate consecutive separative methods. The multistage manufacturing method is recommended when the planar electrode face on the ground electrode is produced before the ground electrode is bent toward the central electrode. However, the cost and complexity may be considerably reduced by manufacturing the first planar electrode face and the second planar electrode face in one step by the separative manufacturing method. A constant distance of the electrode faces is always ensured by the simultaneous manufacturing of the electrode faces using a single tool.

A method characterized in that the formed planar electrode faces are situated parallel to each other may be used. It has been found that electrode faces situated in parallel improve the inflammability of the air-fuel mixture in particular. In an electrode system oriented in this way, the sparkover between the electrode faces is maximum, so that misfirings are minimized and also partial zones of the air-fuel mixture that are not in the immediate surroundings of the spark gap are ignited. In addition, wear of the electrode material is minimum in the case of electrode faces in parallel because the forces acting on the electrode faces are distributed over the total surfaces of the electrodes, which minimizes the force applied per surface segment. The result is a spark plug having a long service life.

A method which is characterized in that the distance between the electrode faces, which forms a defined spark gap, may be achieved via a separative manufacturing method such as cutting using geometrically defined blades. An exceptionally smooth planar face is produced thereby, in which the wear caused by spark erosion is clearly minimized and inflammability of the air-fuel mixture is maximized.

Also, a separative manufacturing method by cutting using geometrically defined blades may be used, and the geometrically defined blade may be a saw blade. Excellent planar separation faces are produced by sawing. In addition, saw blades are available in many different shapes, sizes, and materials. Furthermore, sawing requires no complicated device; therefore it may be accomplished cost-effectively. By suitably selecting a width of the saw blade, both electrode faces may be produced simultaneously in a simple manner and the electrode gap may also be varied. An electrode gap may thus be implemented with a uniformly high accuracy in mass production.

By orienting the saw blade in a predefined direction, the distance and the shape of the electrode faces may be varied in such a way that the inflammability of the air-fuel mixture is optimized. The advantage here is when the saw blade is situated in such a way that a rotation axis of the saw blade is perpendicular to the central axis of the central electrode. This simplifies the construction of the sawing device.

It is furthermore possible to situate the saw blade used for sawing in producing the electrode gap in such a way that the rotation axis of the saw blade forms an angle of 0° to 90° with the central axis of the central electrode. The advantage here is that the spark gap may now be spatially varied so that an orientation in the direction of the ignitable mixture is more easily possible. Furthermore, by tilting the saw blade, the electrode face of the ground electrode and/or the central electrode may be enlarged, thereby maximizing the surface available for spark discharge. Spark discharge and thus also the inflammability of the air-fuel mixture is thus improved.

An arrangement in which the saw blade is oriented in such a way that its rotation axis is parallel to the central axis of the central electrode may also be advantageous. In particular in the case of small electrode gaps, it becomes easier to machine both electrode faces in such a way that the small, defined electrode gap remains ensured. In addition, a design of this type is easy to implement.

Another advantage resulting due to the method according to the present invention for manufacturing a spark plug is that the area of the ground electrode to be bent may be of the same or greater length than in commercially available spark plugs, but at the same time the length of a pin applied to the electrode does not need to be reduced, which would be disadvantageous with respect to the available active electrode face. The longer the area to be bent, the easier it is to bend the ground electrode. However, the space is limited by the pin being applied to the front side of the ground electrode. According to the method according to the present invention, the pin may be shortened to the desired length by the separative method after bending. The area to be bent may thus be longer to begin with and is thus easier to bend. The manufacturing method is thus considerably simplified.

Furthermore, the exemplary embodiments and/or exemplary methods of the present invention relates to a spark plug having a central electrode and a laterally oriented ground electrode, which is characterized in that a distance for a spark gap is formed between the ground electrode and the central electrode by two planar electrode faces. An electrode system in which the ground electrode is laterally oriented is advantageous in that the ignitable air-fuel mixture reaches the spark gap considerably more easily because the spark gap is not covered by the ground electrode. In addition, the planarity of the electrode faces offers decisive advantages: On the one hand, it considerably optimizes the spark discharge and thus also the inflammability of the ignitable air-fuel mixture. On the other hand, it prevents the spark erosive wear of the electrode faces. The spark plug according to the present invention is thus optimized for durability and service life.

The corresponding subclaims show exemplary embodiments of the spark plug electrode according to the present invention.

The spark plug according to the present invention is characterized by a considerably improved inflammability of the air-fuel mixture compared to conventional spark plugs and also by a longer service life due to reduced wear by spark erosion when the two planar electrode faces may be situated parallel to each other.

It is furthermore advantageous if the distance between the two planar electrode faces represents the smallest distance between them because the spark discharge is then optimized and the inflammability of the air-fuel mixture is maximized.

The distance between the planar electrode faces may be 0.3 mm to 1.3 mm because the spark discharge between the electrode faces is then excellent and the air-fuel mixture is ignited in an optimum manner. The best results regarding the spark discharge and inflammability of the air-fuel mixture are achieved at an electrode gap of 0.8 mm.

Each of the planar faces of the electrodes may have a different shape. A shape that may be produced at low cost and little complexity is made possible if the electrode and/or the pin have a cylindrical shape. Different electrode faces may then be produced by the separative manufacturing method depending on the position of the geometrically defined blade, whereby the two planar electrode faces bear the same relationship as a circle to a rectangle, an oval to an oval or a partial oval to a partial oval. It is, however, also possible to design the electrode and/or the pin in the shape of parallelepipeds. The formed planar electrode faces then bear the same relationship as a rectangle to a rectangle. While this is more complicated to manufacture, the opposite parts are then of maximum surface area, which optimizes the spark formation in the spark gap, and thus has a positive effect on the inflammability of the ignitable air-fuel mixture. The effects achievable due to the produced geometric shapes of the electrode faces may be individually adapted to the needs in the combustion chamber. It is also possible that one of the electrodes or the pins is cylindrical and the other electrode or pin has a parallelepiped shape. This produces planar electrode faces that relate to each other as a circle to a rectangle.

Exemplary embodiments of the present invention are described in the following with reference to the accompanying drawings.

DETAILED DESCRIPTION

Figure 1:
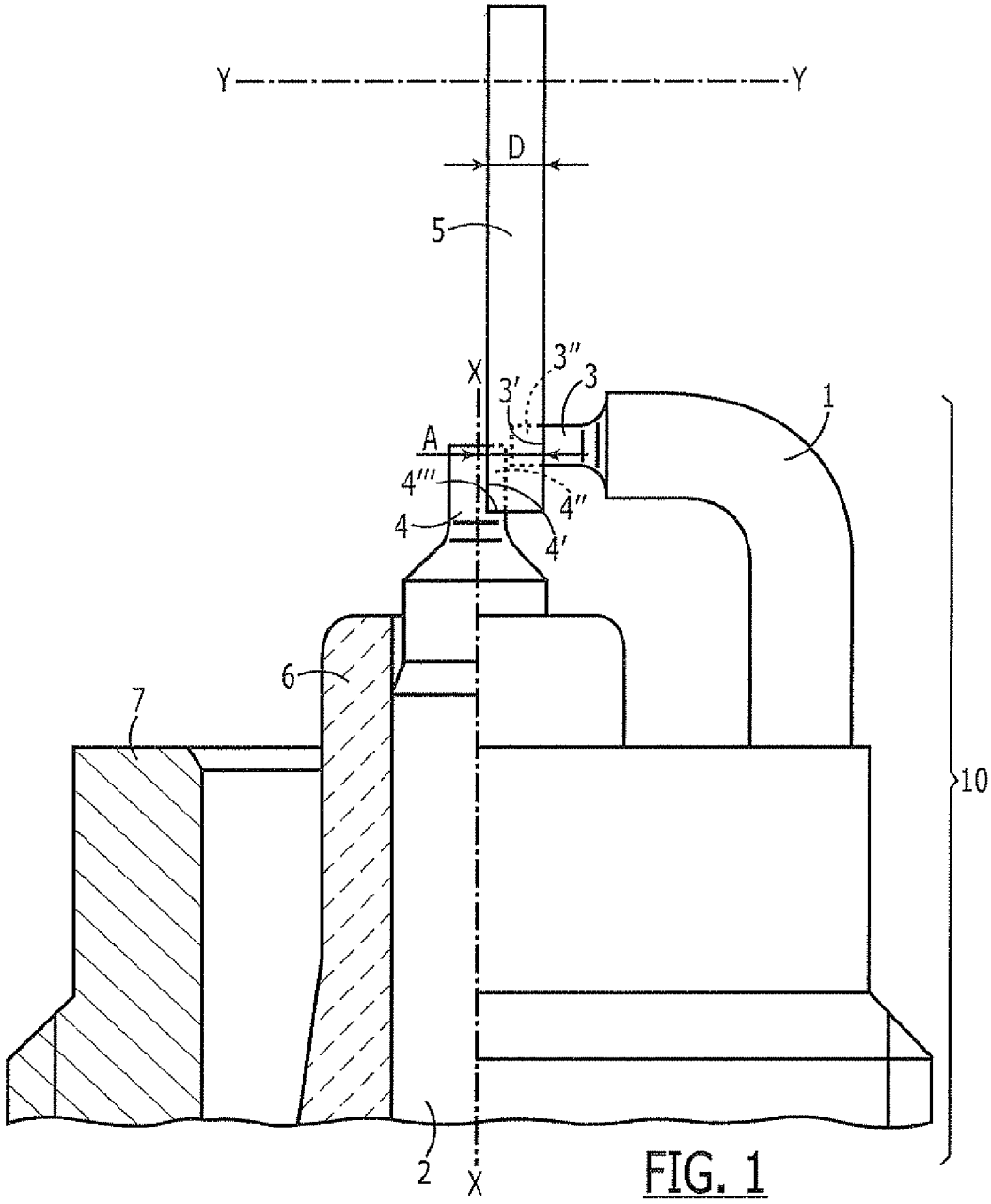
FIG. 1 shows a cross section through a device for manufacturing a spark plug, which is used in a first specific embodiment of the method.

It is understood in the description of the exemplary embodiments that the same reference numerals are used for the same components in the different figures.

A first specific embodiment of the method according to the present invention for manufacturing a spark plug is described in the following with reference to FIGS. 1 and 1*a*.

FIG. 1 shows a spark plug 10 which includes ground electrode 1 and a central electrode 2, an insulation 6 and a housing 7, ground electrode 1 being oriented laterally with respect to central electrode 2. A system in which ground electrode 1 is laterally oriented with respect to central electrode 2 has been found advantageous in that the ignitable air-fuel mixture reaches the spark gap considerably more easily because the spark gap is not covered by ground electrode 1. Pins 4 and 3 are applied to the ends of central electrode 2 and ground electrode 1. Pins 3 and 4 may basically have any desired shape, in particular that of a parallelepiped or may be of a cylinder, depending on the manufacturing process, and are generally for the most part made of a noble metal alloy.

FIG. 1 further shows electrode faces 3' and 4', between which the spark for igniting the air-fuel mixture is discharged. Since the ignitable air-fuel mixture is not necessarily formed directly between electrode faces 3' and 4', but in their close proximity, it is possible that ground electrode 1 is somewhat raised with respect to central electrode 2 in the axial direction X-X of the spark plug. It is therefore even more important that opposite electrode faces 3' and 4' have the greatest possible planar surface areas at the points where they are the smallest distance apart. In the first exemplary embodiment, a cut of saw blade 5 is made in pin 4, but not in the center of the pin, but at a certain distance therefrom, so that electrode face 4' does not have the greatest possible surface area.

The separative manufacturing method according to the present invention is characterized in that the preformed components such as pins 3 and 4, which are applied to the particular electrode front sides of spark plug 10, are post-treated in such a way that fragments 3" and 4" are separated from pins 3 and 4 so that a new electrode face 3' and 4' is exposed, which is characterized by a particularly low surface roughness and therefore extremely high planarity. This is accomplished in that the front end of pin 3 is seized first using a saw blade 5, whose rotation axis Y-Y is perpendicular to central axis X-X of central electrode 2, from the direction of the electrode, by pushing saw blade 5 toward the two electrodes, so that a fragment 3" is cut off by it perpendicularly and then, in the following, also pin 4 of central electrode 2 is seized by saw blade 5, so that also a fragment 4" is separated from pin 4. The deeper saw blade 5 penetrates into pin 4, the greater is this fragment 4". At the lower point of pin 4, at which the saw blade no longer penetrates further, a face 4'" perpendicular to the electrode face is obtained. The depth of penetration into pin 4 must be at least such that a complete fragment 3" of pin 3 is completely separated at the same time, so that a planar electrode face 3' is obtained.

Planar electrode faces 3' and 4' produced by sawing make it possible that the spark discharge is uniform and covers the entire surface, so that the inflammability of the air-fuel mixture is improved and thus increased. Saw blade 5 is responsible for a very uniform cutting face due to its constant, uniform, high-speed rotation, so that electrode faces 3' and 4' have maximum planarity, which has a decisive effect on reducing the spark erosive wear of electrode faces 3' and 4'.

Figure 1A:
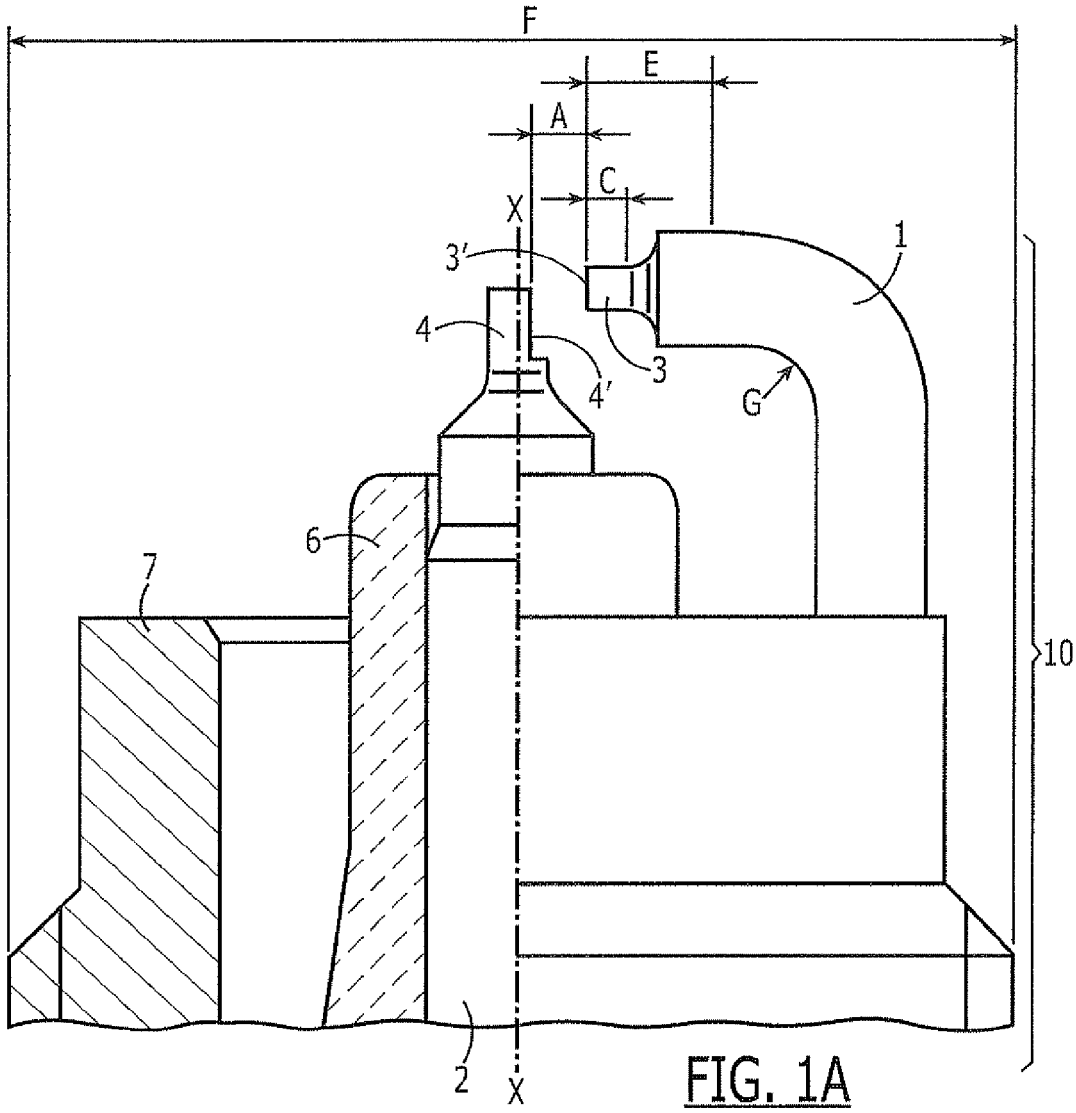
FIG. 1*a* shows a partially sectioned side view of a spark plug which has been manufactured according to the first specific embodiment of the method, supplemented by some details.

As is apparent from FIG. 1*a*, first planar electrode face 4' is situated parallel to second planar electrode face 3' due to the simultaneous manufacture of the electrode faces. F denotes the total diameter of spark plug 10. E denotes the distance of electrode face 3' of ground electrode 1 to the point of ground electrode 1 where a 90° curvature of the ground electrode begins. Distance E is related to distance F in such a way that E may assume values of 0.12 to 0.20 multiplied by F. The distance may be E=0.16*F. This distance E ensures that ground electrode 1 may be easily bent 90° prior to the manufacture of electrode face 3'.

In FIG. 1*a*, A denotes the minimum distance between the two electrode faces 3' and 4', which is obtained by sawing off pin 3 and parts of pin 4 simultaneously. In the first exemplary embodiment, distance A between the two electrode faces 3' and 4' corresponds to a width D of saw blade 5 in FIG. 1 and may be approximately 0.8 mm.

FIG. 1*a* also shows a length C, which provides the length of the straight part of pin 3. Length C of the straight segment of pin 3 may be 0.5 mm. In the case of an excessively short length C, the distance to electrode face 4' is too great, so that a proper sparkover may no longer take place; in the case of an excessively great length, the spark gap is too small for optimum spark discharge.

Furthermore, FIG. 1*a* provides radius G of the curvature of ground electrode 1. Radius G may be between 0.2 mm and 2 mm, and may especially be 1 mm.

Figure 2:
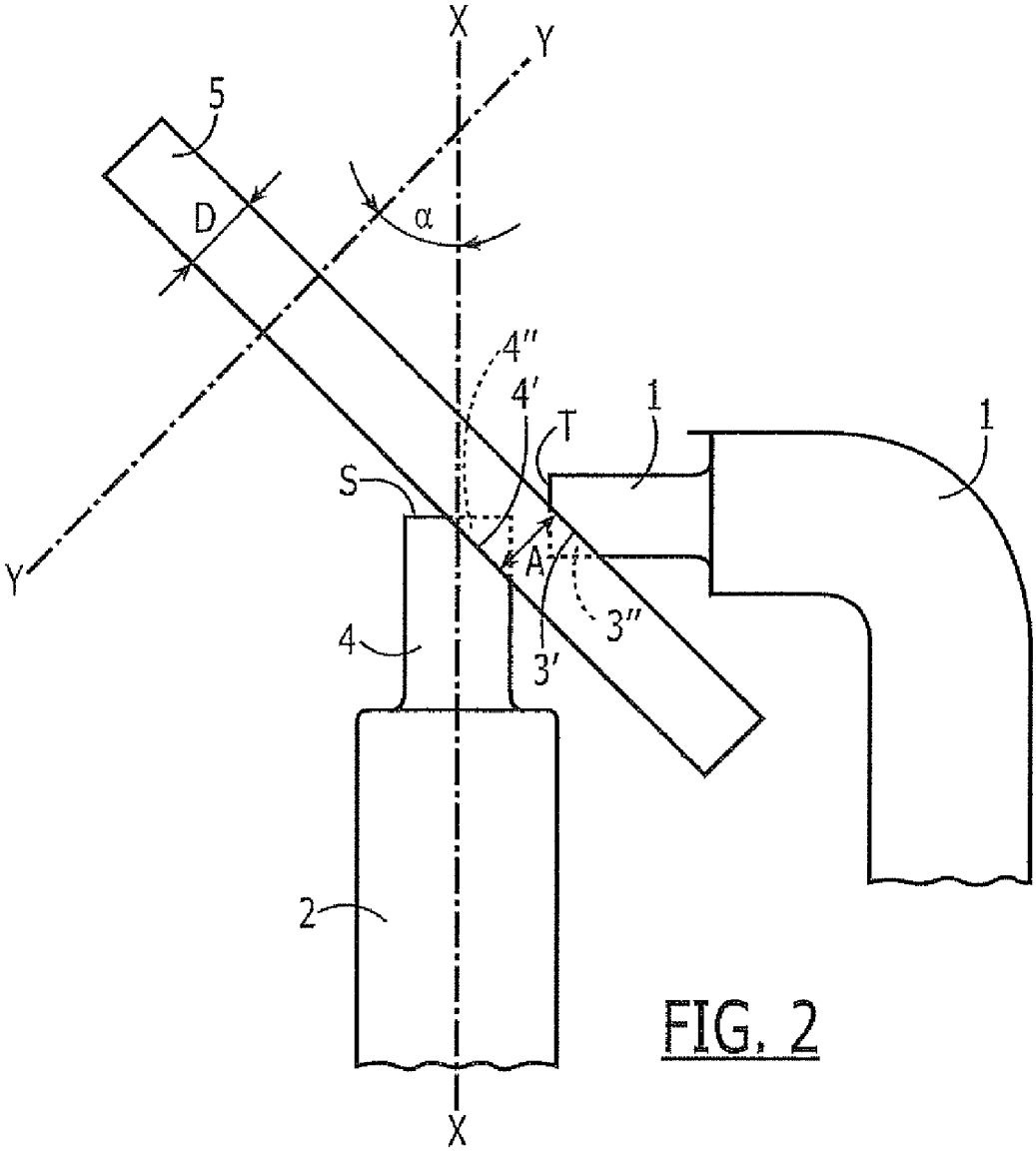
FIG. 2 shows a cross section through a device for manufacturing a spark plug, which is used in a second specific embodiment of the method.
Figure 2A:
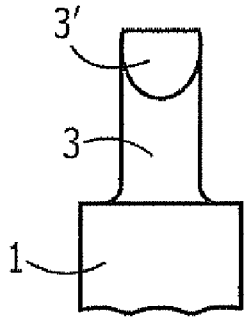
FIG. 2*a* shows the shape of the electrode face in the case of a device for manufacturing a spark plug according to the second specific embodiment.

FIGS. 2 and 2*a* show a second specific embodiment of the present invention. The design of the device for manufacturing a spark plug according to the second specific embodiment is very similar to that of the first specific embodiment. Differences result from the position of saw blade 5. FIG. 2 shows that saw blade 5 may also assume a tilted position. This is the case when rotation axis Y-Y of saw blade 5 is situated at an angle $\alpha$ to central axis X-X of central electrode 2; angle $\alpha$ may assume values between 0° and 90°. In FIG. 2, $\alpha$=45°. Saw blade 5 first cuts into pin 4 at any desired point of front face S of pin 4. At the same time or shortly thereafter, front face T of pin 3 is also seized at an appropriate point by saw blade 5. Fragments 3" and 4" are separated. In FIG. 2, both pins 3 and 4 are of a cylindrical shape, so that after separation of the two fragments 3" and 4", partial ovals result as electrode faces 3' and 4', respectively (see FIG. 2*a*).

FIG. 2*a* shows electrode face 3', which has been manufactured with the aid of the device according to the second specific embodiment of the present invention and which results after separating fragment 3" of the pin of ground electrode 1. T denotes the fragment of pin 3 not seized by saw blade 5.

Figure 3:
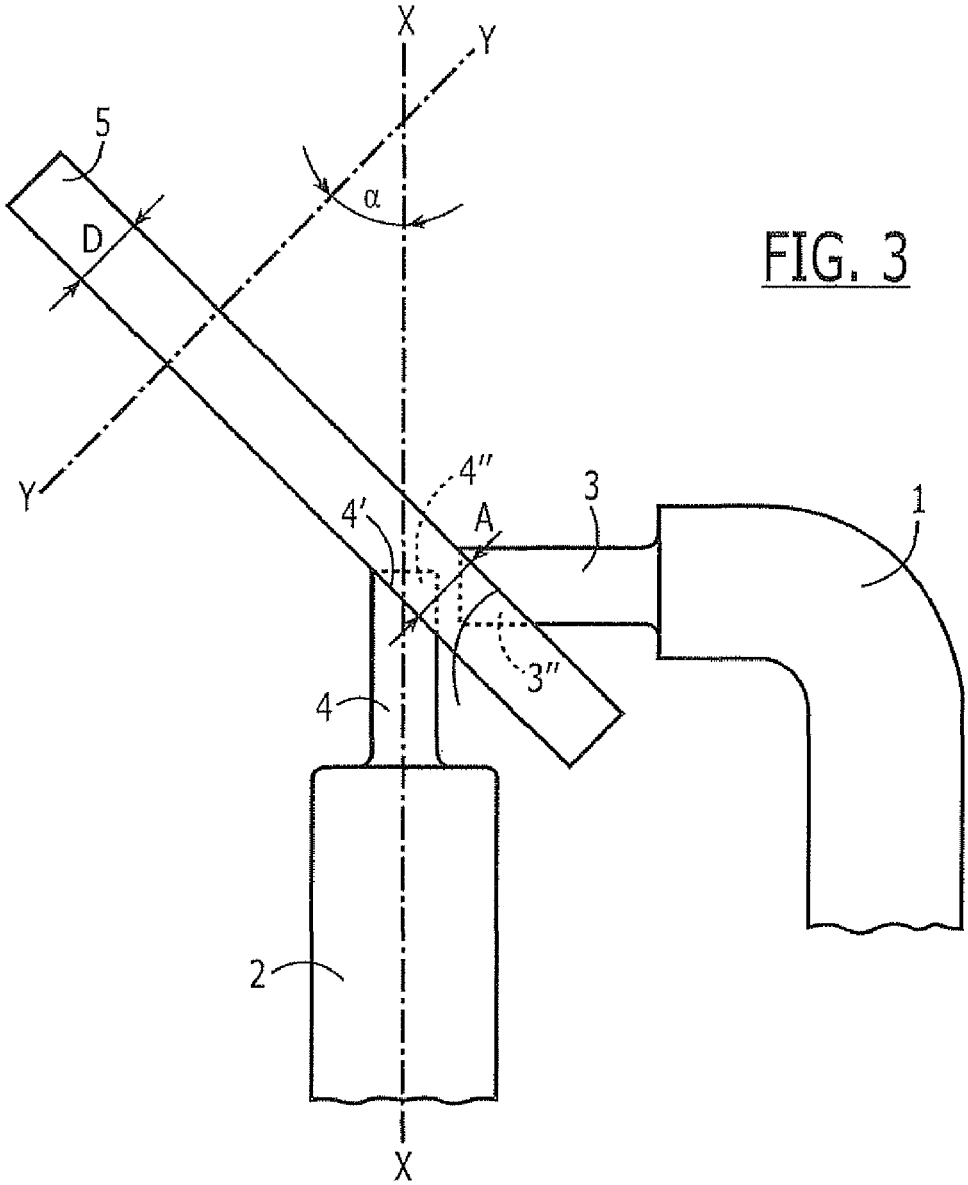
FIG. 3 shows a cross section through a device for manufacturing a spark plug, which is used in a third specific embodiment of the method.
Figure 3A:
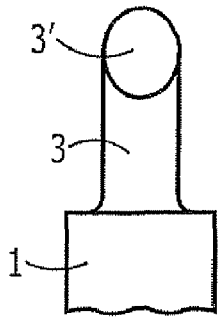
FIG. 3*a* shows the shape of the electrode face in a device for manufacturing a spark plug according to the third specific embodiment.

FIGS. 3 and 3*a* show a spark plug and a method according to a third specific embodiment. Again, angle $\alpha$ for the position of saw blade 5 is 45°, but saw blade 5 cuts exactly into the edge, i.e., the lateral surface area of the two pins 3 and 4. This generates a parallel electrode face in the form of ovals (see FIG. 3*a*), whereby the surface for a spark discharge is very large, so that the inflammability of the air-fuel mixture is high and the wear of electrode faces 3' and 4' is highly reduced.

FIG. 3*a* shows an electrode face 3', when original pin 3 has a cylindrical shape and rotation axis Y-Y of saw blade 5 forms an angle α of 45° with central axis X-X of central electrode 2. An oval is thus formed as the electrode face. The size of the electrode face may be adjusted to predefined conditions by varying angle α.

Figure 4:
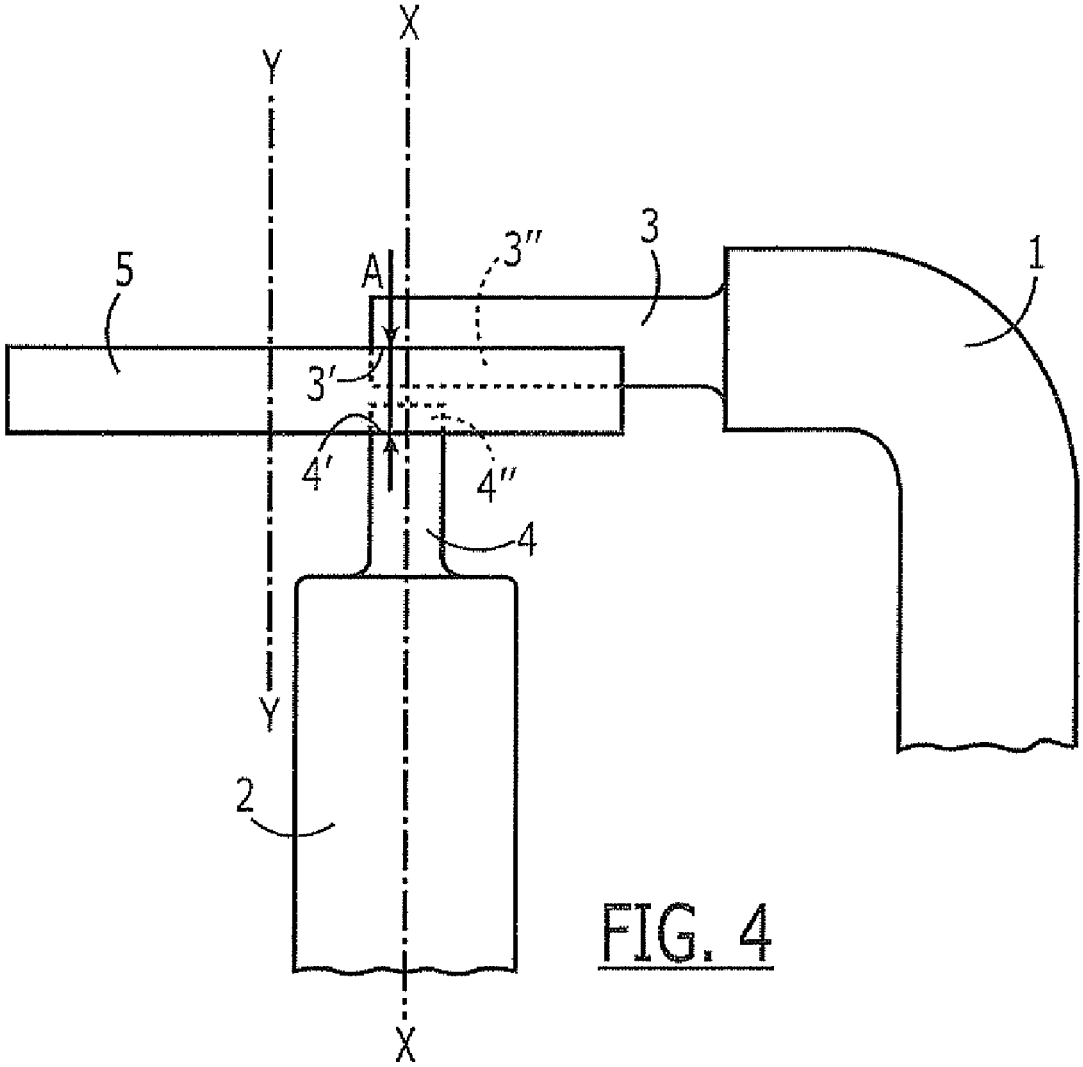
FIG. 4 shows a cross section through a device for manufacturing a spark plug, which is used in a fourth specific embodiment of the method.

FIG. 4 shows a fourth specific embodiment of the present invention. In this specific embodiment, saw blade 5 used for separating pins 3 and 4 is situated in such a way that rotation axis Y-Y of saw blade 5 is situated parallel to central axis X-X of central electrode 2. This represents the case rotated 90° counterclockwise with respect to that of FIG. 1. This arrangement may be used when pin 3 of ground electrode 1 has a very long design. This causes electrode face 3' of ground electrode 1 to lie opposite electrode face 4' of central electrode 2, achieving full coverage of the electrode faces. This makes it possible to produce very large opposing electrode faces 3' and 4', which in turn minimizes the wear on electrode faces 3' and 4' and maximizes the inflammability of the air-fuel mixture. Depending on the shape of pins 3 and 4, electrode faces 3' and 4' of different shapes may be obtained as previously mentioned. In the fourth exemplary embodiment, the cut using saw blade 5 passes through the center of pin 3 to obtain the greatest possible electrode face 3'.

Figure 5A:
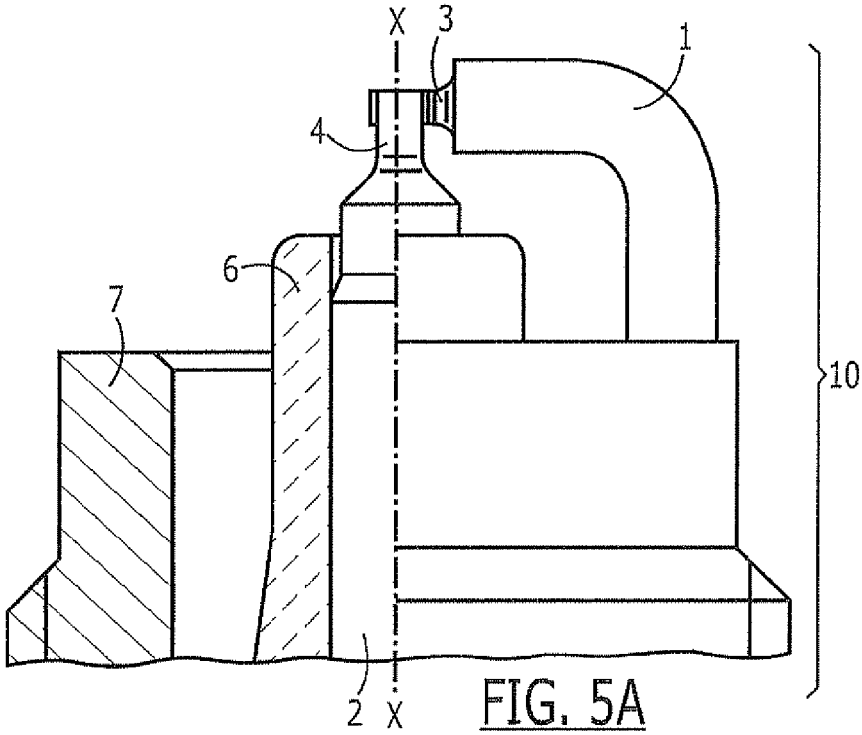
FIG. 5*a* shows a partially sectioned side view of a spark plug according to a fifth exemplary embodiment.
Figure 5B:
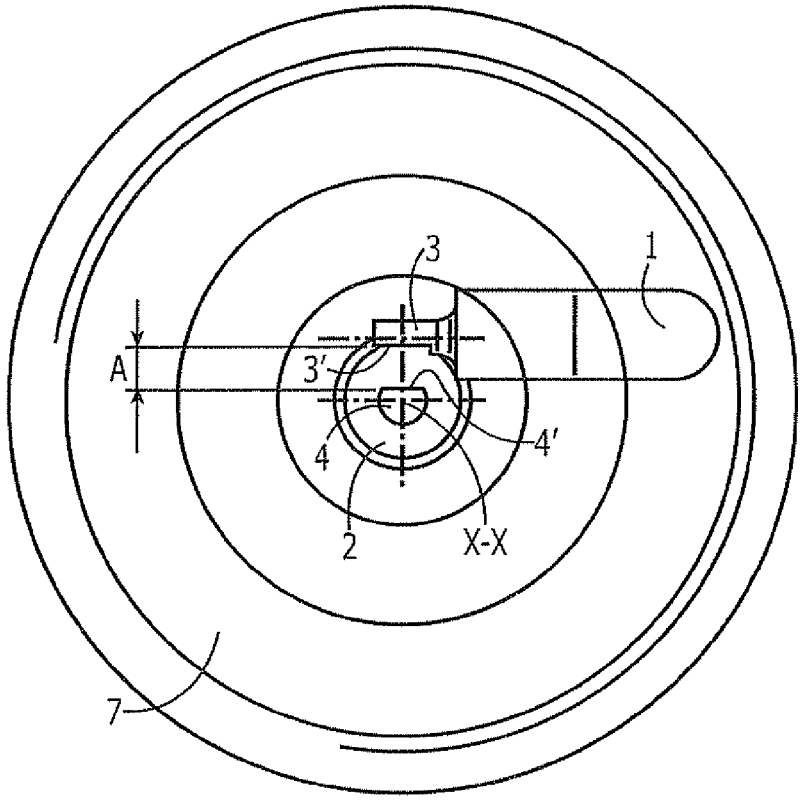
FIG. 5*b* shows a top view onto the spark plug shown in FIG. 5*a*.

FIGS. 5*a* and 5*b* show a fifth specific embodiment of a spark plug according to the present invention. As is apparent, in particular from FIG. 5*b*, central electrode 2 is situated on central axis X-X of spark plug 10 and ground electrode 1 is situated at a lateral distance A from central electrode 2. Distance A is again produced by sawing. As is further apparent from FIG. 5*a*, pin 3 of ground electrode 1 is at the same height as one end of pin 4 of central electrode 2. In other words, a central axis of pin 3, which is situated at a right angle to central axis X-X, is somewhat offset laterally with respect to central axis X-X. The design of this spark plug is suitable, in particular, for gaseous fuels and may be used in gas engines. Otherwise this exemplary embodiment corresponds to the previous exemplary embodiments, so that reference may be made to the description given therein.

What is claimed is:

1. A method for manufacturing a spark plug having a central electrode and a ground electrode, the method comprising:

spacing apart the central electrode and the ground electrode from each other; and forming a first planar electrode face on the central electrode, and forming a second planar electrode face on the ground electrode by a separative manufacturing process, wherein the central electrode and the ground electrode are spaced apart from each other prior to the forming by the separative manufacturing process, and wherein the separative manufacturing process increases the spacing between the central electrode and the ground electrode as compared to the spacing prior to the forming by the separative manufacturing process.

2. The method of claim 1, wherein the first planar electrode face and the second planar electrode face are manufactured in one operation by the separative manufacturing process.

3. The method of claim 1, wherein the first planar electrode face is situated parallel to the second planar electrode face.

4. The method of claim 1, wherein the separative manufacturing process includes cutting using geometrically defined blades.

5. The method of claim 4, wherein the separative manufacturing process includes sawing.

6. The method of claim 5, wherein the saw blade used in sawing for producing the electrode gap is situated so that a rotation axis of the saw blade is situated perpendicular to a central axis of the central electrode.

7. The method of claim 5, wherein the saw blade used in the sawing for producing the electrode gap is situated so that the rotation axis of the saw blade forms an angle α of $0° < \alpha < 90°$ with the central axis of the central electrode.

8. The method of claim 5, wherein the saw blade used in sawing for producing the electrode gap is situated so that the rotation axis of the saw blade is situated parallel to the central axis of the central electrode.

* * * * *